US007367746B2

(12) United States Patent
Hosokawa

(10) Patent No.: US 7,367,746 B2
(45) Date of Patent: May 6, 2008

(54) LIFTING POLE APPARATUS FOR TRAFFIC CONTROL

(75) Inventor: Kazutaka Hosokawa, Odawara (JP)

(73) Assignee: Koei Industry Co., Ltd., Odawara-shi, Kanagawa-Ken (JP)

( * ) Notice: Subject to any disclaimer, the term of this patent is extended or adjusted under 35 U.S.C. 154(b) by 315 days.

(21) Appl. No.: 11/236,652

(22) Filed: Sep. 28, 2005

(65) Prior Publication Data

US 2007/0068078 A1 Mar. 29, 2007

(51) Int. Cl.
*E01F 9/018* (2006.01)
*E01F 9/019* (2006.01)

(52) U.S. Cl. ..... 404/11; 49/49

(58) Field of Classification Search ..... 404/11; 49/49

See application file for complete search history.

(56) References Cited

U.S. PATENT DOCUMENTS 3,086,430 A * 4/1963 Emmel ..... 404/6
3,771,488 A * 11/1973 Ecke ..... 114/218
4,635,492 A * 1/1987 Uebelhart ..... 74/89.35
4,919,563 A * 4/1990 Stice ..... 404/6
7,244,075 B2 * 7/2007 Stadler ..... 404/6

FOREIGN PATENT DOCUMENTS

DE 29606794 U1 * 8/1996
FR 2650009 A1 * 1/1991
JP 10053394 A 2/1998
JP 2003213636 A 7/2003

* cited by examiner

*Primary Examiner*—Raymond W Addie
(74) *Attorney, Agent, or Firm*—Baker & Hostetler LLP

(57) ABSTRACT

There is provided a lifting pole apparatus which can lift and lower a pole having such strength as to be capable of preventing cars from entering. The lifting pole apparatus comprises a cylindrical pole which is capable of lifting and lowering inside a housing case; a screw shaft hanging from a top portion of the pole inwardly; a stay disposed upright on a bottom portion of the housing case, and housed in the pole; a driving gear rotatably supported on the stay, and having a screw portion on a through hole disposed at a center axis thereof, the screw portion being threadably mounted on the screw shaft; at least two motors disposed on the stay for rotating the driving gear; and an electro-magnetic brake disposed on the stay for activating the brake on the rotation of the driving gear.

11 Claims, 4 Drawing Sheets

LIFTING POLE APPARATUS FOR TRAFFIC CONTROL

FIELD OF THE INVENTION

The present invention relates to a lifting pole apparatus for traffic control and more specifically relates to lifting pole apparatuses which having improved impact-resistance can be used as a barrier surrounding a site of building structures, parking spaces, and the like for interrupting human beings, cars, and the like passing through, or traffic control means and the like.

BACKGROUND OF THE INVENTION

Recently, there can be frequently seen a barrier, what is called, a high pole type barrier in which lifting poles that can be housed in a housing case placed under the ground are installed at entry and exit points of a car parking and the like.

Such general lifting pole apparatuses are so constructed that the poles are pulled up or put down manually. This operation is very troublesome, and hence the chances are that the poles unfavorably go out of use while they are still put down with the lapse of time. That is, in a case where the lifting pole apparatuses are installed in front of a car port, a user puts down the poles manually before getting in a car, and then gets the car out of the car port, thereafter pulls up the poles manually. In this way, the lifting and lowering operation of the poles are very troublesome, accordingly, they are still put down with the lapse of time, resulting in a useless and obstructive thing.

In a case where the parking space is of a private-use size, about two or three poles will suffice; however, in a case where the lifting pole apparatuses are used as a barrier for parking zones of a large-scale super market and the like, there are used a number of the lifting pole apparatuses. In that case, lifting and lowering the poles one by one manually will bring serious consequences.

Therefore, there is proposed a motor-operated type lifting pole apparatus which lifts and lowers a pole using a motor in order to make the operation simple and make the use easy. This conventional example is disclosed in Japanese Patent Application Laid-Open No. H10-53394, and Japanese Patent Application Laid-Open No. 2003-213636.

In a lifting pole apparatus disclosed in Japanese Patent Application Laid-Open No. H10-53394, a motor is disposed at a bottom portion in a housing case, an output shaft of the motor is engaged with a driving shaft, and the driving shaft extends along a center axis of the housing case. Further, a nut portion to be screwed on the driving shaft is disposed, and a pole is interlocked with the nut portion. The construction is that the rotation of the driving shaft by the motor causes the nut portion to move up and down along the driving shaft, which lifts and lowers the pole.

However, since the lifting pole apparatus disclosed in Japanese Patent Application Laid-Open No. H10-53394 is so constructed to drive, by the motor, the driving shaft extending along the center axis of the housing case over the total length, the motor has to be disposed in the housing case on its bottom portion. There is a possibility that rainwater and the like may enter into and accumulated in the housing case; accordingly, installing an electrical system including a motor on the bottom portion increases the possibility of the failures occurring.

To this end, there is disclosed in Japanese Patent Application Laid-Open No. 2003-213636 a construction which is capable of installing a motor at a relatively high level in a housing case. In this lifting pole apparatus, a stay for use in a driving mechanism including a motor comprises a column disposed upright on a bottom portion of the housing case, a flange formed on an upper end portion of the column, and a mounting base fixed to the flange. Thus disposing the stay and installing the driving mechanism at a relatively high level enables the electrical system to be protected even if water accumulates on the bottom.

In this construction, the motor is devised to drive a driving gear through an intermediate gear, both of which are rotatably supported on the stay. Further, the driving gear is threadably mounted on a screw shaft which hangs from a top portion of the pole inwardly; accordingly, the rotation of the driving gear causes the pole to lift and lower. That is, the motor serves as a driving system for driving the driving gear (nut), which has an inverted relationship to a case of Japanese Patent Application Laid-Open No. H10-53394 in which the motor serves as a driving system for driving the driving shaft. This makes it possible to dispose the electrical system including the motor on the stay at a relatively high level.

The motor used in the motor-operated type lifting pole apparatus mentioned above can be applied by only small-sized one which is capable of being housed in the housing case. In other words, a motor which is capable of being used has its limit in size, and hence an output torque of lifting and lowering the pole has its limit. To this end, it is recommended to make the pole, which is lifted and lowered by the motor, as light as possible.

On the other hand, from a viewpoint of recent terrorism-prevention countermeasures, there has been a demand of utilizing the lifting pole apparatuses as a barricade for preventing the vehicles from entering. That is, for the purpose of preventing a suicide bombing using a car, it is intended to install the lifting pole apparatuses, as traffic control means, on a road surface at entry and exit points of the important facilities, and then lift the poles as needed to thereby prevent the dangerous car from entering. But, in the above-mentioned conventional lifting pole apparatuses, the pole which is capable of lifting and lowering has its limit in weight; therefore, the pole having such a high strength as to stop the vehicle from colliding becomes, if it is desired to be realized, too heavy, which provides a problem that the existing apparatus cannot demonstrate an output torque required for lifting and lowering the pole.

SUMMARY OF THE INVENTION

It is therefore an object of the invention to dissolve the above technical problems provided in the conventional lifting pole apparatus.

Further, it is another object of the invention to provide a lifting pole apparatus which lifts and lowers a pole having such a high strength as to prevent the vehicles from entering.

The lifting pole apparatus according to the invention having the above objects is characterized by comprising a cylindrical pole which is capable of lifting and lowering inside a housing case; a screw shaft hanging from a top portion of the pole inwardly; a stay disposed upright on a bottom portion of the housing case, and can be housed in the pole; a driving gear rotatably supported on the stay, and having a screw portion on a through hole disposed at a center axis thereof, the screw portion being threadably mounted on the screw shaft; at least two motors disposed on the stay for rotating the driving gear; and an electro-magnetic brake disposed on the stay for activating the brake on the rotation of the driving gear.

This lifting pole apparatus is so devised that the rotation of the driving gear causes the screw shaft screwed on the driving gear to lift and lower, thereby causing the pole to be lifted and lowered. Further, there are disposed two or more motors for rotating the driving gear, thereby creating the output torque twice as large as the prior art. Since the pole is thus lifted and lowered by a plurality of the motors, the pole can be made not less than 2 cm in thickness, and not less than 35 cm in diameter, for example, which makes the pole so tough as to resist against the collision of a car. On the contrary, there occurs a problem that although the lifted pole has to be kept at the top dead center, even a plurality of the motors cannot continue to support the weight of the pole, thereby causing the pole to unfavorably lower in a gradual manner. To this end, it is so devised that an electro-magnetic brake for activating the brake on the rotation of the driving gear is disposed on the stay, as means for dissolving this problem, and then operating the electro-magnetic brake after the pole reaches the top dead center to thereby lock the driving gear to a stop. Also, this electro-magnetic brake is available during the pole lowering, and hence can serve to prevent the breakage of the apparatus by activating the brake once before the pole reaches the bottom dead center until which the lowering speed increases due to the weight, to thereby decrease the lowering speed before the pole reaches the bottom dead center.

Taking the weight of the pole into consideration, it is more preferable to dispose intermediate gears between the driving gear and output shaft gears of the motors, respectively, and increase the torque according to the gear ratios related to the intermediate gear. Further, when the intermediate gears are disposed, it is preferable to dispose at least one brake gear which is rotatably supported on the stay and meshes with at least one intermediate gear, and dispose the electro-magnetic brake on a rotation shaft of the brake gear.

A preferable aspect of the invention described above is to cover and waterproof-seal the stay at above the stay by a cover, and install the motors, the driving gear, the electro-magnetic brake, and a control circuit thereof in the cover. Particularly, there can be disposed a mechanism in which is rotatably supported on the top portion of the pole at its base portion, and its base end portion protrudes through the top portion of the pole to the outside, and an engaging lid is engaged with and put on the base end portion from the outside of the pole for preventing the rotation of the screw shaft. According to the construction described as above, when the motor cannot be operated due to power failure, it enables the pole to be lifted and lowered that the base end portion of the screw shaft exposed with the engaging lid removed is rotated by a manual tool.

The lifting pole apparatus according to the invention is of an electric motor-operated type, and hence can be remotely operated by a remote controller and further can be operated if the user is still in a car. Moreover, the apparatus is of a motor-driven type; accordingly it reduces a noise. Moreover, carrying out the locking by the use of the electrical braking system eliminates the need for a mechanical locking mechanism for keeping the pole at the top dead center, thereby reducing the causes of failures.

When a plurality of the lifting pole apparatuses according to the invention are arranged, they have built-in motors, respectively, it is possible to lift and lower a number of poles individually. That is, it is easy to lift and lower a plurality of the lifting poles at a time, or to lift and lower any of them selectively, by the use of the computer control and the like.

BRIEF EXPLANATION OF THE DRAWINGS

The above and other objects, features and advantages of this invention will be understood from the following description with reference to the accompanying drawings wherein.

DETAILED DESCRIPTION OF THE INVENTION

Figure 1:
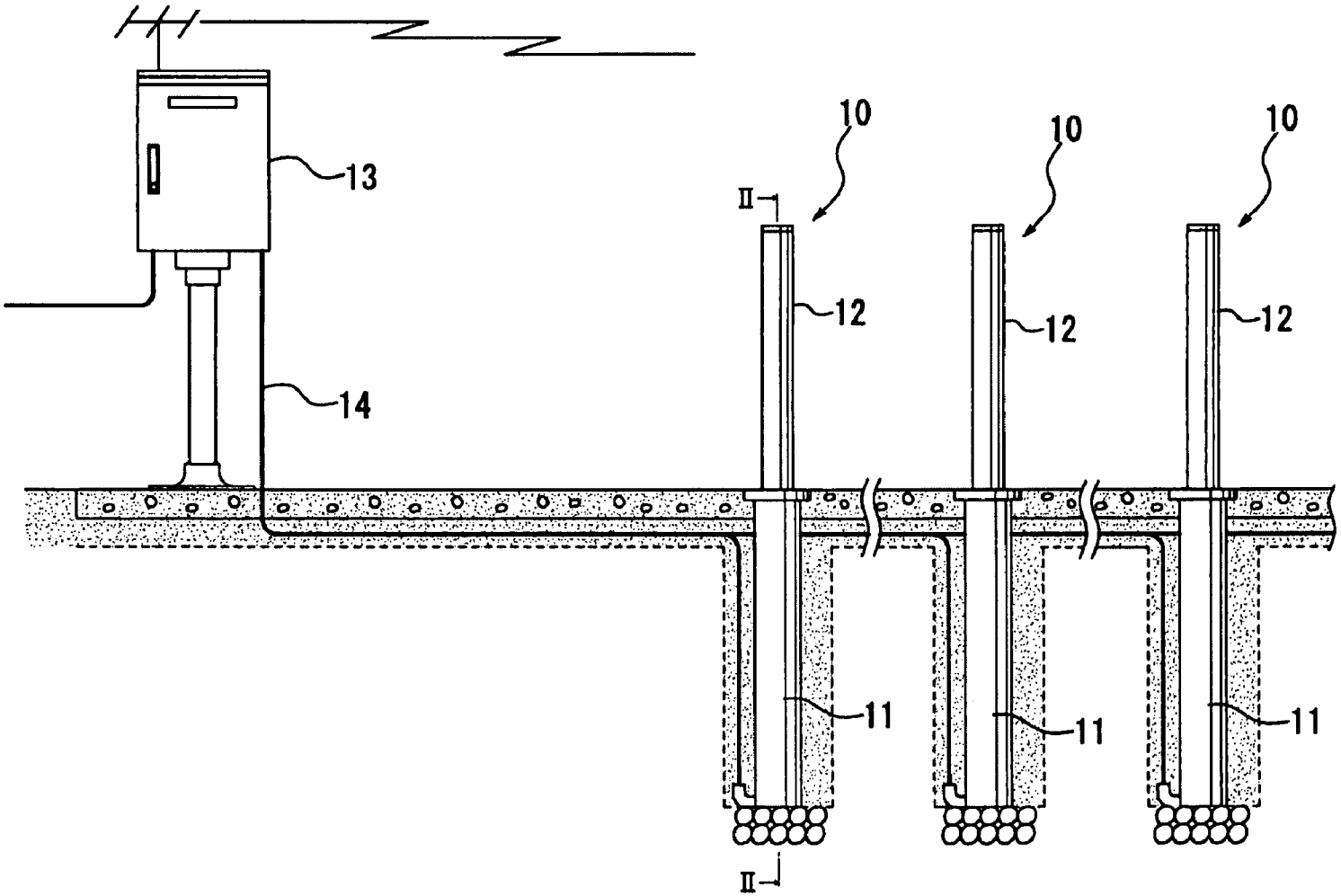
FIG. 1 is a view showing an installation example of arranging and electrically interconnecting a plurality of lifting pole apparatuses according to the invention.

Referring to FIG. 1, there is illustrated a motor-operated type lifting pole apparatus 10 according to the present embodiment, which comprises a cylindrical housing case 11 placed under the surface of the earth, and a cylindrical pole 12 lifting and lowering inside the housing case 11. Arranging a plurality of the lifting pole apparatuses 10 of the same construction forms a barrier surrounding a site of building structures, parking spaces and the like, or traffic control means including bumping posts in the entry and exit points, and the like.

Electric source/signal cables 14 are drawn into each of the lifting pole apparatuses 10 from a control device 13, thereby causing the lifting pole apparatuses 10 to be controlled, individually. The control device 13 is remotely controlled in a wireless system from a distance, and is capable of controlling lifting and lowering the poles 12.

Figure 2:
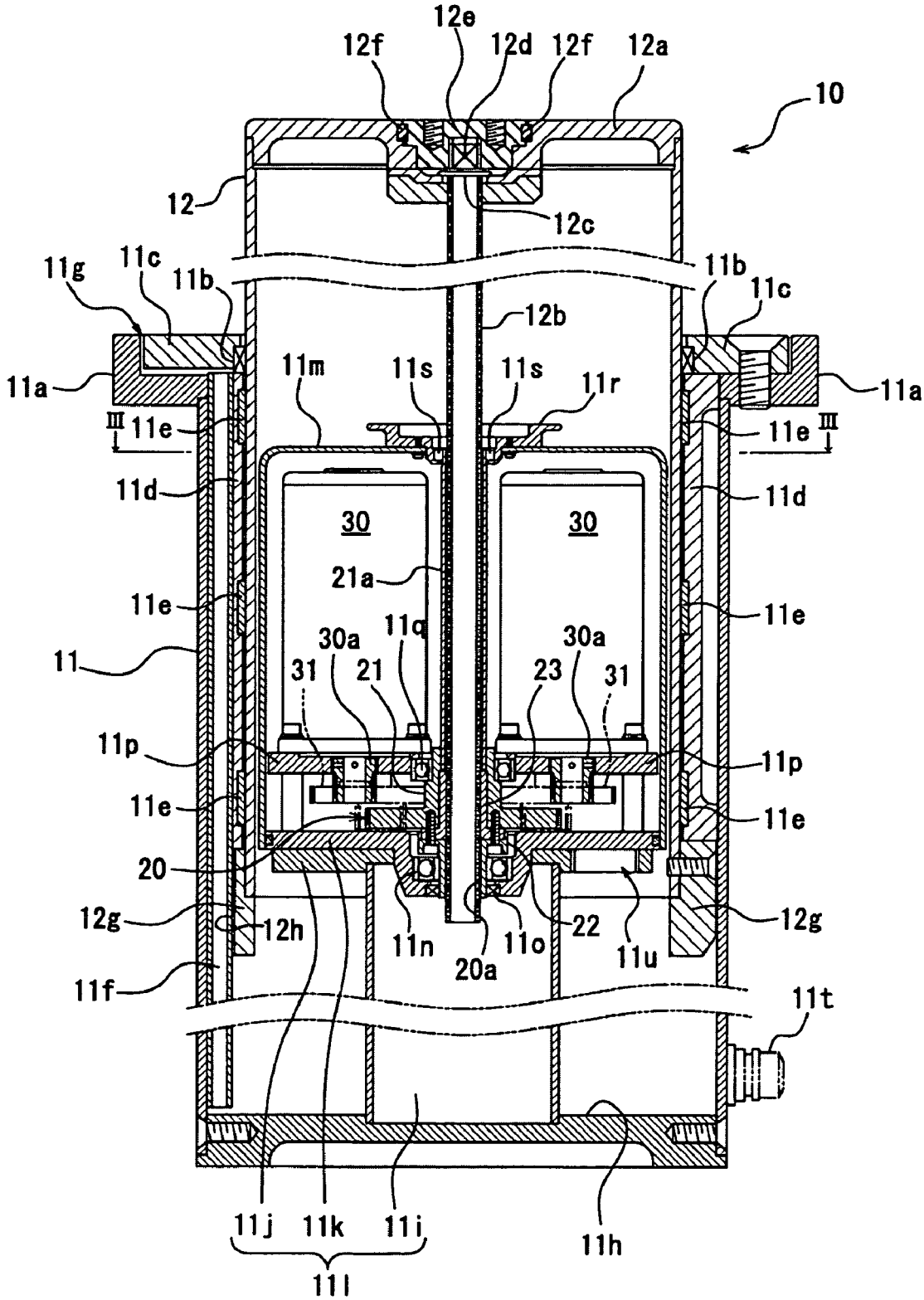
FIG. 2 is a sectional view of the lifting pole apparatus according to this invention taking along the line II-II.

There is shown in FIG. 2 a detailed construction of each of the lifting pole apparatuses 10. FIG. 2 is a sectional view with intermediate portions of the housing case 11 and the pole 12 broken and omitted, and with the pole 12 positioned at the top dead center. Further, there are shown in FIG. 3 an inner construction of the lifting pole apparatus 10 viewed from above, and a main part including an electro-magnetic brake is shown in a sectional view of FIG. 4. including an electro-magnetic brake is shown in a sectional view of FIG. 4.

Figure 3:
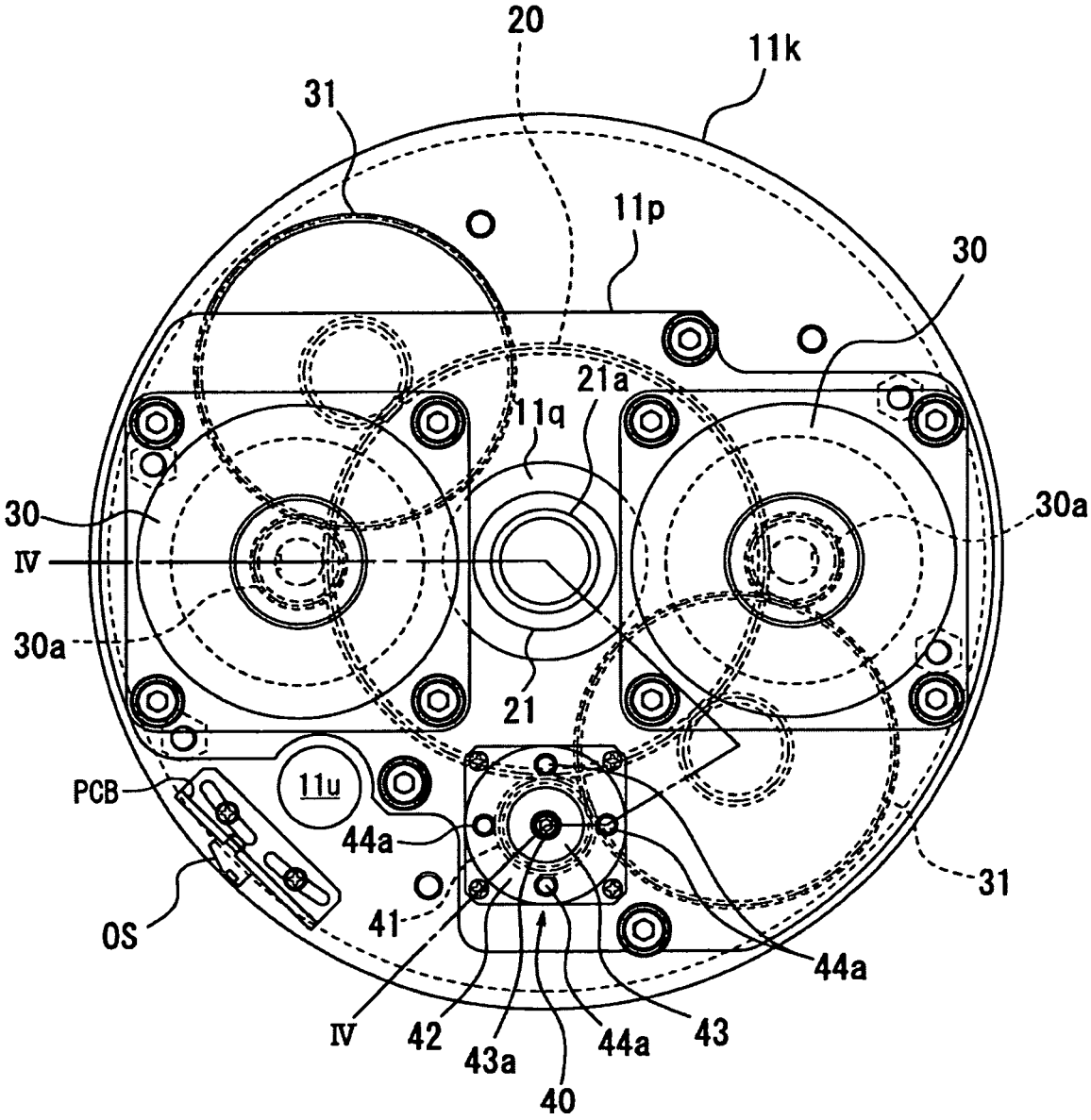
FIG. 3 is a plan view of an internal driving system, taken along the line III-III viewed from above, which is disposed on a stay in the lifting pole apparatus shown in FIG. 2 with a cover removed.

Referring to FIGS. 2 and 3, the housing case 11 is shaped like a cylinder with a bottom, with a diameter lager than that of the pole 12, and has a flange 11*a* formed at its upper opening end. Screw-fixed to the flange 11*a* is a seal flange 11*c* having an inner circumferential surface, into which a dust seal 11*b* formed of an elastic ring is fitted. This dust seal 11*b* abutting against an outer circumferential surface of the pole 12 at least ensures the waterproof of an inner space of the housing case 11 to the outside.

Further, fitted inside an upper opening end portion of the housing case 11 is a cylindrical slide bearing 11*d* serving as a guide of lifting and lowering operation of the pole 12. On an inner circumferential surface of the slide bearing 11*d* is fitted three polytetrafluoroethylene (Teflon(Trade Mark)) rings 11*e*, so that the pole 12 is devised to be very smoothly slid.

Moreover, arranged straightforward on an inner circumferential surface of the housing case 11 from the bottom to the upper opening end is at least one water drain pipe 11*f*, so that this water drain pipe 11*f* is adapted to be communicated with the outside through a gap 11g which is partially opened between the flange 11a and the seal flange 11c. To this end, even if rainwater and the like accumulate on a bottom portion of the housing case 11, they can be discharged to the outside through the water drain pipe 11f due to the internal pressure occurring during the pole 12 lowering. Further, the water drain pipe 1 if is shaped like a straight line, and also serves as a guide member for guiding a stopper for preventing the rotation of the pole 12, as descried below.

A driving mechanism-used stay 11l is constructed by disposing a hollow column 11i reaching the height of the slide bearing 11d upright on the bottom portion 11h of the housing case 11, forming the flange 11j on an upper end portion of the column 11i, and then fixing a mounting base 11k to the flange 11j. Installing the driving mechanism on thus disposed stay 11l at a high level causes the electrical system to be protected even if water accumulates on the bottom. Furthermore, the stay 11l is covered with a cover 11m, thereby improving the waterproof. The stay 11l and the cover 11m are so sized as to be housed inside the pole 12.

The pole 12 lifting and lowering in such a housing case 11 is shaped like a cylinder which is hermetically closed by a top cover 12a at its top portion, and the screw shaft 12b is rotatably supported by the top cover 12a and hangs into the pole 12. The screw shaft 12b has substantially the same length as the pole 12, and passes through a bearing of the top cover 12a at its base portion and has a C-like retaining ring 12c fitted thereto, to thereby be rotatably supported by the bearing. Furthermore, a base end portion 12d of the screw shaft 12b comprises a rectangular cross-section engaging piece which protrudes through the top cover 12a to the outside. An engaging lid 12e is put on and engaged with the base end portion 12d from above, and is fixed to the top cover 12a. Typically, the engagement between the engaging lid 12e and the base end portion 12d stops the screw shaft 12b from rotating. Moreover, a waterproof elastic ring 12f is disposed between the engaging lid 12e and the top cover 12a.

On the other hand, as for the lower part of the pole 12, the pole 12 has a ring-like top dead center stopper 12g fixed to an outer circumference of its lower portion opening end portion. Abutment of the stopper 12g against a lower end of the slide bearing 11d of the housing case 11 stops the pole 12 from lifting. Moreover, the top dead center stopper 12g is formed with a gutter 12h through which the drain pipe 11f passes. Engaging the both with each other constitutes a rotation stopper for preventing the pole 12 from rotating. Preferably, this top dead center stopper 12g is coated by using Teflon (Trade Mark).

In the stay 11l and the cover 11m which are housed in the pole 12, a driving gear 20 is rotatably supported and two motors 30 for rotating the driving gear 20 are disposed.

The driving gear 20 is rotatably supported, at its lower end portion, on a radial ball bearing 11n disposed on the mounting base 11k at its center portion. Moreover, an oil seal 11o is disposed on an outer (lower) side of the radial ball bearing 11n, thereby preventing gear oil and the like from leaking, or water from entering. On the other hand, an upper end portion of the driving gear 20 is rotatably supported on a radial ball bearing 11q disposed on a motor support 11p for fixing the motors 30.

The driving gear 20 of this embodiment has a construction of sandwiching and screw-fixing a nut 23 by a gear piece 21 rotatably supported on the radial ball bearing 11q at its upper end portion and an adapter 22 rotatably supported on the radial ball bearing 11n at its lower portion. The screw shaft 12b is inserted into a through hole 20a penetrating through centers of the gear piece 21, the nut 23, and the adapter 22, among which the nut 23 serves as a screw portion to be threadably mounted on the screw shaft 12b, and hence the rotation of the nut 23 causes the screw shaft 12b to lift and lower. Further, a shield pipe 21a which is communicated with the through hole 20a extends upward from the gear piece 21, and then an upper end portion of the shield pipe 21a passes through the cover 11m to the outside. That is, the shield pipe 21a passes through a center hole, surrounded by a bearing seal 11s, of a dust-proof cover plate 11r disposed at a center of the cover 11m, and hence protrudes from the cover 11m to the outside at its upper end portion. The screw shaft 12b hangs through inside the shield pipe 21a and threadably mounted on the nut 23, to thereby be protected so as not to come in contact with the driving mechanism.

As best shown in FIG. 3, the two motors 30 for rotating such a driving gear 20 are fixed to the motor support 11p disposed in the cover 11m at a predetermined distance from the mounting base 11k of the stay 11l. Two intermediate gears 31 are rotatably supported on bearings between the motor support 11p and the mounting base 11k in order to secure the driving force. The driving force by output shaft gears 30a of the motors 30 is transmitted to the driving gear 20 via the corresponding intermediate gears 31, respectively.

Referring again FIGS. 2 and 3, the motor 30 is controlled by a printed circuit board PCB disposed at an open area in the cover 11m. The circuit substrate PCB is connected with the electric source/signal cable 14 (FIG. 1) wired from a cable conduit 11t of the housing case 11 through a cable hole 11u of the stay 11l. As for the circuit board PCB, disposing an overcurrent sensor realizes the safety control by detecting the overcurrent occurring when the pole 12 cannot lift because an article is placed on the pole 12 when the pole 12 is positioned, for example, at a housing position, or the overcurrent occurring when the pole 12 reaches the top dead center, to thereby bring an emergency stop to the motors 30 as a safe control. Moreover, disposing an optical sensor OS for detecting the top dead center and the bottom dead center of the pole 12 realizes such a control as to stop the pole 12 from lifting and lowering according to an output of the optical sensor OS. Further, it is recommended to form a circuit for providing a brake electric current of electrically braking the two motors 30.

As described above, the pole 12 according to the present invention is as large as not less than 2 cm in thickness and not less than 35 cm in diameter to thereby be made so tough as to bear against the collision of a vehicle, so that only the electrical control by the two motors 30 makes it difficult to keep holding the pole 12 at the top dead center. Therefore, in this embodiment, a single electro-magnetic brake is disposed on one of the intermediate gears 31 (a plurality of the electro-magnetic brakes can be disposed for all the intermediate gears 31). This electro-magnetic brake 40 can hold the pole 12, even if it is heavy, at the top dead center, and then be used in place of a mechanical locking mechanism which may break down frequently. Further, disposition of the electro-magnetic brake 40 enables the control of holding the pole 12 at any height, and the control of preventing the breakage by activating the brake once before the pole 12 reaches the bottom dead center until which the lowering speed increases due to the weight, to thereby decrease the lowering speed before the pole 12 reaches the bottom dead center.

The electro-magnetic brake 40 according to the present embodiment is disposed on the rotation shaft 41a of the brake gear 41 rotatably supported on the bearing between the motor support 11p and the mounting base 11k. The brake gear 41 is meshed with the intermediate gear 41; accordingly, it is possible to activate the brake on the rotation of the driving gear 20 via the intermediate gear 31.

Figure 4:
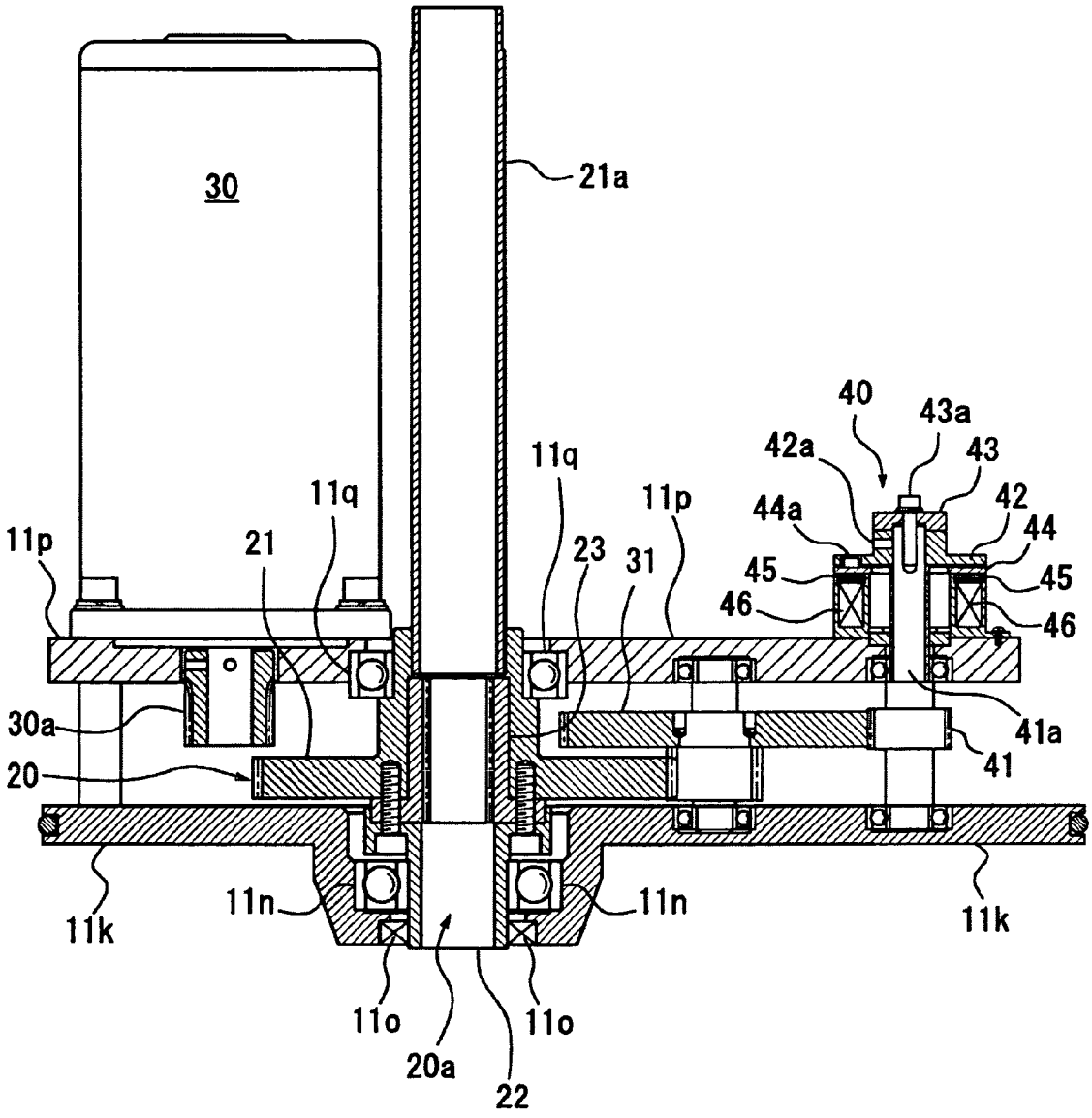
FIG. 4 is a sectional view taken along the line IV-IV of FIG. 3.

More specifically, as best shown in FIG. 4, the rotation shaft 41*a* of the brake gear 41 extends through the motor support lip, and the extended portion of the rotation shaft 41*a* is provided with the electro-magnetic brake 40. In the electro-magnetic brake 40, a rotor hub 42 is fixed to an upper end portion of the rotation shaft 41*a* by a lock screw 42*a*, and pressed by fixing a retainer plate 43 to the shaft by a screw 43*a* from above. A donut-like armature 44 is attached to a lower surface of the rotor hub 42 while being urged upward by a very thin plate spring (not shown), and then rotated together with the rotor hub 42 by four pins 44*a*.

A stator 46 is installed below the armature 44 via a friction body 45, and hence energizing the stator 46 causes the armature 44 to be attracted toward the friction body 45, thereby stopping its rotation. That is, in a state in which the stator 46 is not energized, the armature 44 is biased toward the rotor hub 42 by the urge while allowing a clearance against the friction body 45. Accordingly, the rotor hub 42 is made free, thereby enabling the rotation shaft 41*a* to rotate without resistance. On the other hand, when energizing the stator 46, the magnetic force occurring on the stator 46 allows the armature 44 to be attracted toward the friction body 45 against the urge to abut against the friction body 45, so that the friction force suppresses the rotation of the rotor hub 42.

Therefore, when stopping energizing the electro-magnetic brake 40 on the motor 30 starting to rotate, the brake gear 41 is made free and then the motor 30 rotates the driving gear 20 to lift and lower the pole 12. On the other hand, when energizing the electro-magnetic brake 40 on the motor 30 stopping its rotation, the brake is activated and then the brake gear 41 stops the rotation of the driving gear 20 via the intermediate gear 31.

That is, during the pole 12 lifting, stopping energizing the electro-magnetic brake 40 makes the brake gear 41 free to release the rotation lock of the driving gear 20, and allows the motor 30 to rotate the driving gear 20 to lift the pole 12. Then, stopping the motor 30 on the pole 12 reaching the top dead center, and energizing the electro-magnetic brake 40 causes the brake to be activated to stop the brake gear 41, thereby allowing the driving gear 20 to be locked to a stop to hold the pole 12 at the top dead center. On the other hand, during the pole 12 lowering, stopping energizing the electro-magnetic brake 40 makes the brake gear 41 free to release the rotation lock of the driving gear 20, and allows the motor 30 to rotate the driving gear 20 to lower the pole 12. On this occasion, since the lowering speed increases due to the weight of the pole 12, the optical sensor, or the like detects that the pole 12 is immediately before reaching the bottom dead center, followed by energizing the electro-magnetic brake 40 to once activate the brake, and preventing the rotation of the driving gear 20 by the brake gear 41 while stopping the drive of the motor 30. Then, releasing the brake by stopping energizing the electro-magnetic brake 40 while the motor 30 still stops causes the pole 12 to naturally lower to the bottom dead center due to the weight of the pole 12. This decreases the lowering speed of the pole 12 before the pole 12 reaches the bottom dead center, thereby preventing the breakage failure of the apparatus.

In the above-mentioned lifting pole apparatus 10 according to this embodiment is so constructed that, in a case where chains and the like are not attached to the upper portion of the pole 12, when the pole 12 reaches the bottom dead center, an end face of the uppermost portion of the pole 12 is flush with the installation surface (the ground or the like), thereby enabling the barrier-free control to be addressed.

The lifting pole apparatus according to the invention is of a motor-operated type, and hence can be remotely operated by a switch and a remote controller which are equipped at a distance and further can be operated if the user is still in a car or a house. Moreover, the apparatus is of a motor-driven type; accordingly it reduces a noise. Therefore, the pole 12 can be lifted and lowered at a residential street at night without worry.

Moreover, the lifting pole apparatus according to the invention is of an electric motor-driven type that enables the battery backup, and can be operated even in an emergency such as power failure. Therefore, when the lifting pole apparatuses are installed as bumping posts at entrances of the important facilities, it contributes to the prevention of crimes. Further, even in the power failure, removing the engaging lid and then rotating the base end portion of the screw shaft when occasion demands enables the pole to be lifted and lowered by a manual operation.

In addition, since the lifting pole apparatus according to the invention has an built-in motor, it is possible to lift and lower a number of lifting poles at a time, or selectively. The application of this technique realizes an establishment of a lane-changing system according to a time zone, a time zone control system employing a guidepath form in a large-scale parking space, or the like. Further, it is applicable to a guidepath control for not only vehicles, but also a site in which queues of people are formed, such as entrances of a base ball stadium.

While only selected embodiments have been chosen to illustrate the present invention, it will be apparent to those skilled in the art from this disclosure that various change and modification can be made herein without departing from the scope of the invention as defined in the appended climes.

Furthermore, the foregoing descriptions of the embodiments according to the present invention are provided for illustration only, and not for the purpose of limiting the invention as defined by the appended claims and their equivalents.

I claim:

1. A lifting pole apparatus comprising:

a cylindrical pole which is capable of lifting and lowering inside a housing case;

a screw shaft hanging from a top portion of said pole inwardly;

a stay disposed upright on a bottom portion of said housing case, and can be housed in said pole;

a driving gear rotatably supported on said stay, and having a screw portion on a through hole disposed at a center axis thereof, said screw portion being threadably mounted on said screw shaft;

at least two motors disposed on said stay for rotating said driving gear; and an electro-magnetic brake disposed on said stay which is activated for slowing or stopping the rotation of said driving gear.

2. A lifting pole apparatus as claimed in claim 1, wherein said electro-magnetic brake locks the rotation of said driving gear to a stop after said pole has reached the top dead center.

3. A lifting pole apparatus as claimed in claim 1, wherein said electro-magnetic brake is activated to decrease the lowering speed of said pole before said pole reaches the bottom dead center during the lowering.

4. A lifting pole apparatus as claimed in claim 1, wherein intermediate gears are disposed between said driving gear and output shafts of said motors, respectively.

5. A lifting pole apparatus as claimed in claim 4, comprising at least one brake gear rotatably supported on said stay and meshing with at least one of said intermediate gears, wherein said electro-magnetic brake is disposed on a rotation shaft of said brake gear.

6. A lifting pole apparatus as claimed in claim 1, wherein a shielding pipe extends upward from said driving gear, and said screw shaft passes through said shielding pipe to be threadably mounted on said driving gear.

7. A lifting pole apparatus as claimed in claim 1, wherein said stay is covered by a cover in a waterproof-sealed manner, and said motors, said driving gear, said electro-magnetic brake, and a control circuit thereof are installed in said cover.

8. A lifting pole apparatus as claimed in claim 1, wherein said screw shaft is rotatably supported on said top portion of said pole at a base portion thereof, and protrudes to the outside of said pole at a base end portion thereof, and an engaging lid for preventing the rotation of said screw shaft is engaged with and put on said base end portion from the outside of said pole.

9. A lifting pole apparatus as claimed in claim 1 is used as traffic control means by arranging a plurality of said apparatuses.

10. A lifting pole apparatus comprising at least:

cylindrical pole means having a top portion, said means being capable of lifting and lowering inside housing case means arranged at a predetermined region;

screw shaft means hanging from a top portion of the pole means into said pole means;

pedestal means constituting a stay disposed upright on a bottom portion of said housing case means into said pole means;

driving gear means rotatably supported on said pedestal means for lifting and lowering said screw shaft means by the rotation;

driving source means which is capable of applying a rotatably driving force at least two positions to the driving gear means; and electro-magnetic braking means disposed on said pedestal means, for activating the brake on the rotation of said driving gear means.

11. A lifting pole apparatus as claimed in claim 10, wherein said driving source means comprises at least two motor means for applying a rotatably driving force to said driving gear means, and control means for controlling an operation of said electric motor means.

* * * * *

UNITED STATES PATENT AND TRADEMARK OFFICE

CERTIFICATE OF CORRECTION

PATENT NO. : 7,367,746 B2
APPLICATION NO. : 11/236652
DATED : May 6, 2008
INVENTOR(S) : Kazutaka Hosokawa It is certified that error appears in the above-identified patent and that said Letters Patent is hereby corrected as shown below:

On the title page, item [75] should read:

--Kazutaka Hosokawa
Odawara-shi (JP)--.

Signed and Sealed this

Twenty-third Day of September, 2008

JON W. DUDAS
*Director of the United States Patent and Trademark Office*